US005846122A

United States Patent [19]

Graebner et al.

[11] Patent Number: 5,846,122

[45] Date of Patent: Dec. 8, 1998

[54] METHOD AND APPARATUS FOR POLISHING METAL-SOLUBLE MATERIALS SUCH AS DIAMOND

[75] Inventors: John Edwin Graebner, Short Hills; Sungho Jin, Millington; Guenther Wilhelm Kammlott, Watchung; Wei Zhu, North Plainfield, all of N.J.

[73] Assignee: Lucent Technologies Inc., Murray Hill, N.J.

[21] Appl. No.: 429,259

[22] Filed: Apr. 25, 1995

[51] Int. Cl.[6] ..... B24B 1/00; B24B 7/19; B24B 7/30

[52] U.S. Cl. ..... 451/28; 451/41; 451/36

[58] Field of Search ..... 451/59, 28, 60, 451/36, 77, 300, 285, 287, 490, 506, 41

[56] References Cited

U.S. PATENT DOCUMENTS

| | | | |
|---|---|---|---|
| 4,475,981 | 10/1984 | Rea | 156/636 |
| 4,601,134 | 7/1986 | Hessemann | 451/300 |
| 4,645,561 | 2/1987 | Rea | 156/636 |
| 5,064,683 | 11/1991 | Poon et al. | 451/28 |
| 5,142,828 | 9/1992 | Curry, II | 451/36 |
| 5,149,338 | 9/1992 | Fulton . | |
| 5,154,021 | 10/1992 | Bonbardier | 451/444 |
| 5,154,023 | 10/1992 | Sioshansi | 451/54 |
| 5,207,759 | 5/1993 | Mehmandoust et al. | 451/36 |
| 5,506,061 | 4/1996 | Kindl et al. | 428/549 |
| 5,538,462 | 7/1996 | Gnadt | 451/28 |

FOREIGN PATENT DOCUMENTS

| | | | |
|---|---|---|---|
| 0 366 027 | 5/1990 | European Pat. Off. . | |
| 0 618 043 | 10/1994 | European Pat. Off. . | |
| 358186554 | 10/1983 | Japan | 451/28 |
| 363144930 | 6/1988 | Japan | 451/28 |
| A 1-071653 | 3/1989 | Japan . | |
| A 2-119136 | 5/1990 | Japan . | |
| A 4-370948 | 12/1992 | Japan . | |
| A 5-102053 | 5/1993 | Japan . | |

OTHER PUBLICATIONS

S. Jim et al. "Shaping of diamond films by etching with molten rare–earth metals, *Nature,* vol. 362, pp. 822–824 (1993).

S. Jin et al. "Polishing of CVD diamond by diffusional reaction with manganese powder, *Diamond and Related Materials,* vol. 1, pp. 949–953 (1992).

*Primary Examiner*—James G. Smith
*Assistant Examiner*—Derris H. Banks
*Attorney, Agent, or Firm*—Glen E. Books

[57] ABSTRACT

Applicants have discovered a new method for fine polishing surfaces of metal-soluble materials such as diamond to the submicron level. The method involves applying to the material surface a polishing medium composed of metal powder and an acidic or basic carrier. The surface is then polished by high speed rubbing to a submicron finish. Several embodiments of apparatus for performing the polishing are described.

7 Claims, 3 Drawing Sheets

METHOD AND APPARATUS FOR POLISHING METAL-SOLUBLE MATERIALS SUCH AS DIAMOND

FIELD OF THE INVENTION

This invention relates to methods and apparatus for fine polishing of metal-soluble materials such as diamond and nitrides. The method uses metal particles dispersed in an acidic or basic carrier to provide atomic scale polishing at near-ambient temperatures.

BACKGROUND OF THE INVENTION

Diamond has many useful properties. Among the known materials, diamond has the highest mechanical hardness, the highest elastic modulus, the highest atomic density and the highest thermal conductivity at room temperature. In addition, diamond is chemically inert and is transparent to radiation from the ultraviolet to the infrared. Diamond can also be made into a wide band-gap semiconductor useful at high temperature and high voltage conditions. These remarkable properties, in combination with the relative ease of growing diamond films, have made diamonds desirable as heat spreaders for high power electronic devices, optical windows, low-friction or wear-resistant surfaces, coatings for cutting tool, and components for active electronic devices.

Nearly all diamond applications require shaping, and thinning or polishing to produce a finished surface roughness below one micrometer. An even finer finish (below ~1000 angstroms roughness) is desirable for certain applications such as optical windows where surface roughness is detrimental to light transmission. Diamond films produced by chemical vapor deposition (CVD films), typically exhibit faceted growth surfaces with an undesirable roughness. In addition, the bottom layer of the film (where diamond nucleation and initial growth takes place) consists of fine grains with many grain boundaries, producing inferior thermal and optical properties. For these reasons, it is desirable to remove both the top and bottom parts of the as-grown diamond films. Unfortunately, because of the hardness of diamond, thinning and polishing by conventional mechanical abrading technique is time-consuming and costly.

Low-cost, high-speed diamond thinning techniques using diffusional interactions with carbon-dissolving metals have been reported in recent years. See, for example, Jin et al., "Shaping of Diamond Films by Etching with Molten Rare-Earth Metals" 362 *Nature* 822 (1993) and Jin et al, "Polishing of CVD Diamond by Diffusional reaction with Manganese Powder", 1 *Diamond and Related Materials* 949 (1992). These techniques typically use high temperature reactions at 700°–900° C. and produce etched diamond surfaces with a coarse surface roughness of a micron or more. Even after this treatment the etched diamond requires further polishing to achieve submicron-scale smooth surfaces. Accordingly, there is a need for convenient and inexpensive polishing technique to produce smooth diamond surface finishes.

SUMMARY OF THE INVENTION

Applicants have discovered a new method for fine polishing surfaces of metal-soluble materials such as diamond to the submicron level. The method involves applying to the material surface a polishing medium composed of metal powder and an acidic or basic carrier. The surface is then polished by high speed rubbing to a submicron finish. Several embodiments of apparatus for performing the polishing are described.

BRIEF DESCRIPTION OF THE DRAWINGS

The nature, advantages and various additional features of the invention will appear more fully upon consideration of the illustrative embodiments now to be described in detail in connection with the accompanying drawings. In the drawings.

It is to be understood that the drawings are for purposes of illustrating the concepts and principles of the invention and are not to scale.

DETAILED DESCRIPTION

Figure 1:
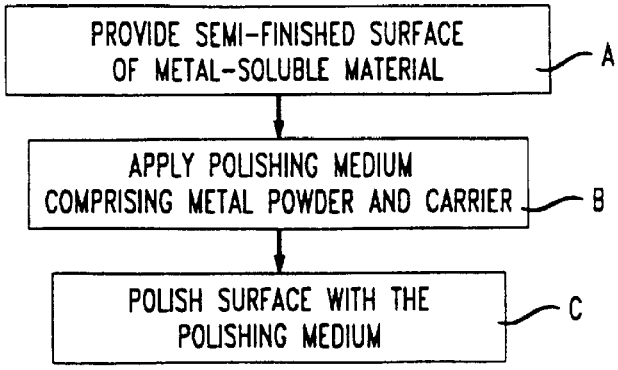
FIG. 1 is a block diagram of the processing steps involved in the polishing.

Referring to the drawings, FIG. 1 is a block diagram of the steps in fine polishing a surface of metal-soluble material. The first step (block A) is to provide a surface of metal-soluble material to be polished. Exemplary metal-soluble materials include diamond and nitrides. A material is metal soluble for these purposes if it has a solid solubility of at least 0.01 atomic percent in the metal at a temperature of 200° C. or less. The surface can be composed of polycrystalline or single crystal material. Typically it will be a diamond film, either as deposited or with a semi-finished surface condition ready for final polishing. It is preferred that the surface to be polished have a starting surface roughness on the order of a few microns or less but more than about 50 angstroms. Surface roughness referred to herein is the root-mean-square (r.m.s.) surface roughness as measured by atomic force microscopy. Such a semi-finished surface can be obtained by conventional mechanical polishing or by the aforementioned high-temperature (~700°–900° C.) diffusion reactions.

The material to be polished may have flat, curved or wavy surfaces depending on the specific application. Curved surfaces, for example, are useful for refractive diamond lenses. Wavy surfaces are useful in diamond Fresnel lenses. Both curved and wavy surfaces can be finish-polished to have desired smooth (but non-flat) surfaces.

The second step (Block B in FIG. 1) is to apply to the surface to be polished a mixture of metal powder and a metal-dissolving carrier (acidic or basic). As a preliminary step, the polishing medium can be prepared by mixing fine powder of metal with the carrier. Carbon-dissolving metals for polishing diamond include transition metals such as Mn or Fe or alloys thereof, and rare earth metals such as Ce, La, Y, or alloys thereof (mischmetal, La—Ni, Ce—Ag alloys). Mn is a preferred carbon-dissolving metal because it exhibits high solubility of carbon even at relatively low temperatures below ~200° C. (See "Binary Alloy Phase Diagrams", ASM International, 1990, p. 860).

The carbon-dissolving metal powders typically have maximum particle size predominantly (>90% by weight) in the range of 1–1000 $\mu$m, and preferably in the range 5–200

μm. Other non-active fine particles such as silica ($SiO_2$) or alumina ($Al_2O_3$) may be added for the purpose of controlling the viscosity of the polishing medium and for ease of handling.

For polishing diamond, the preferred metal-dissolving carrier is a liquid acidic carrier such as hydrochloric acid, nitric acid, sulfuric acid, hydrofluoric acid, acetic acid or mixtures thereof. Desired concentration of the acid is typically in the range of 1–50 volume percent in water. The carrier makes the polishing reaction possible. It is a carrier for the metal powder, and it continuously etches off the surface oxide on the metal powder (the presence of which would interfere with the metal-carbon interaction for diamond dissolution and stop the polishing). It also continuously etches off the reaction product e.g., the carbon-containing Mn layer on the surface of Mn particles or on the diamond surface. The carrier thus continuously exposes fresh metal and fresh diamond surface to allow the polishing reactions to continue.

The third step in FIG. 1 (block C) is to polish the surface by rubbing. High speed rotating or reciprocating pads or rubbing brushes may be used. For high polishing speed and for enhancing local heating at the contact points, the desired speed of brush motion is in the range of 10–10,000 rpm rotation or equivalent linear speed, and preferably in the range of 100–1000 rpm.

The exact mechanism of polishing is not completely understood, but it is believed that there is instantaneous, atomic-scale heating during abrasion of the metal powder against the elevated portions of the material surface. This abrasion causes, at the contact points atomic-scale dissolution of the material into the metal, resulting in an atomic-scale polishing.

The temperature of the polishing medium is preferably kept near ambient room temperature for the sake of convenience, but it can be raised to as high as ~200° C. if a high polishing rate is desired. The brush is preferably made up of a chemically inactive (e.g. acid or base resistant) polymer, plastic, or glass fiber. Brushes may also be made of acid-resistant stainless steel, aluminum, or titanium alloy. Alternatively, the brush itself can also be made of carbon-dissolving metal, such as Mn, Fe, or their alloys. In such case the brush metals actively participate in the polishing reaction as a consumable material.

The present polishing technique can be used not only for diamond but also for carbide materials. It can also be applied to nitride materials by using powders of metals with relatively high solid solubility of nitrogen at low temperatures. Preferred nitrogen-dissolving metals include V, Zr, Fe, Ce, La or their alloys. Technologically important nitrides such as cubic-BN, AlN, GaN, InN or their alloys can be fine polished for electronic, optical and acoustical applications. In this case, the metal removes the nitrogen part and the acid removes the metallic element part from the nitride being polished. In the case of AlN polishing, a base carrier, such as a NaOH or KOH solution, is preferred over acid since Al is relatively resistant to acid etching but dissolves easily in these base solutions. For this approach to be useful for these and other materials, the thermodynamic conditions of the specific involved materials under the local abrasion contact conditions (i.e., local instantaneous temperature and pressure) should be such that the material dissolves in the metals with a net decrease in the free energy.

Figure 2:
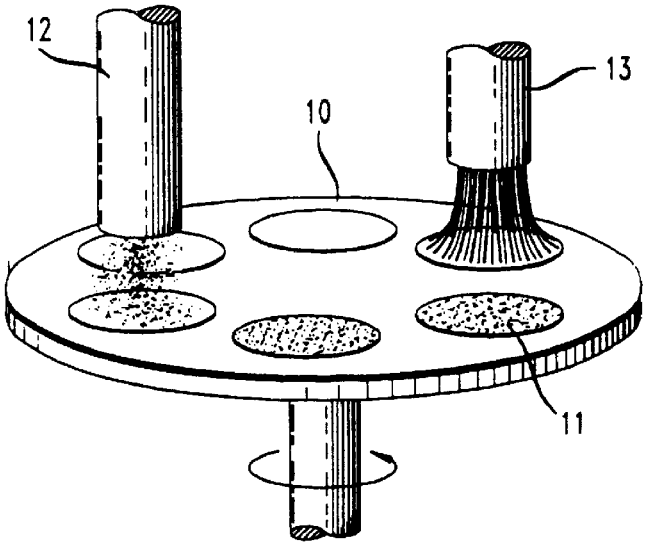
FIG. 2 schematically illustrates a first embodiment of polishing apparatus useful in the process of FIG. 1.

FIG. 2 illustrates preferred apparatus useful in practicing the method of FIG. 1. The apparatus comprises a support member 10 such as a rotatable plate for holding one or more samples 11 to be polished (e.g. diamond films), a conduit such as tube 12 for applying the polishing medium, and a movable polishing member 13 such as a rotatable brush. The plate 10 is preferably made of or coated with non-corrosive materials, such as glass, ceramic, polymer, stainless steel or aluminum. In operation, the samples 11 are mounted on the plate 10 and the polishing medium (preferably Mn-powder/acid for diamond) is supplied through tube 12. The plate is rotated, and the samples are polished by brush 13.

Figure 3:
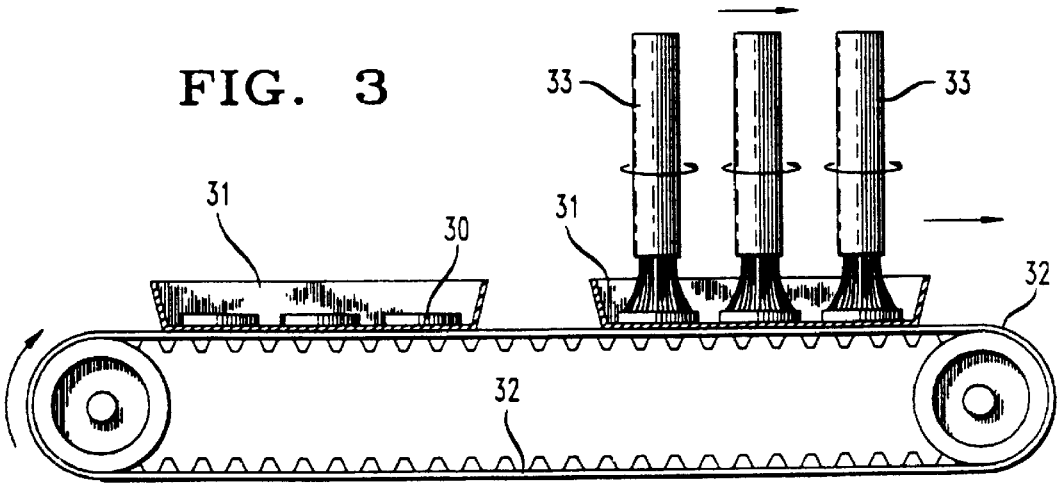
FIG. 3 shows a second embodiment of the polishing apparatus.

FIG. 3 is a polishing apparatus suitable for continuous operation. Here samples 30 are placed in a series of containers 31 which in turn are placed on a movable conveyer belt 32. One or more tubes (not shown) are provided for continuously supplying the polishing medium onto the sample surface. The samples are polished by rotating brushes 33 that advantageously travel at the same speed as the conveyer belt.

Figure 4:
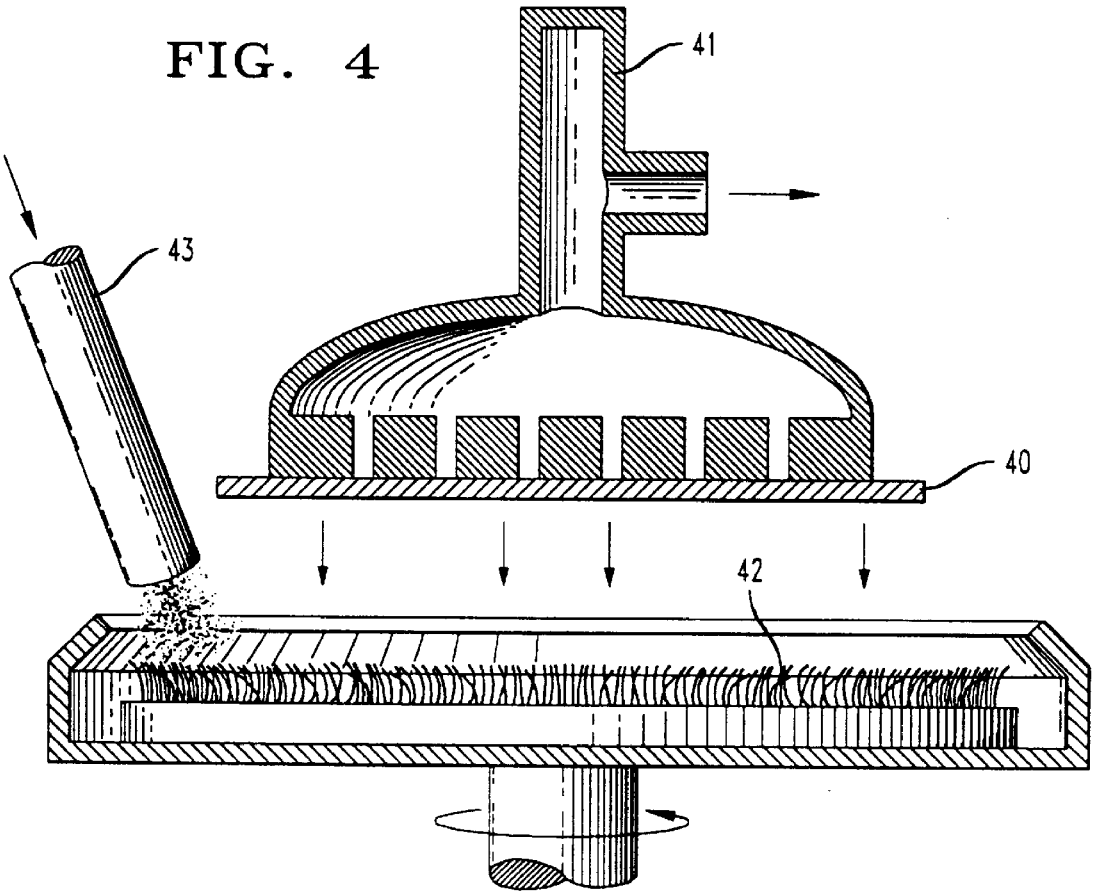
FIG. 4 shows a third embodiment of polishing apparatus.

FIG. 4 shows a third polishing apparatus. Here the samples 40 can be held upside down on the bottom of vacuum suction holder 41, which is then lowered onto a rotating polishing pad or brush 42 wet with the polishing medium via tube 43. Alternatively, the sample can be placed on the bottom of the sample holder by mechanical means or by gluing.

Figure 5:
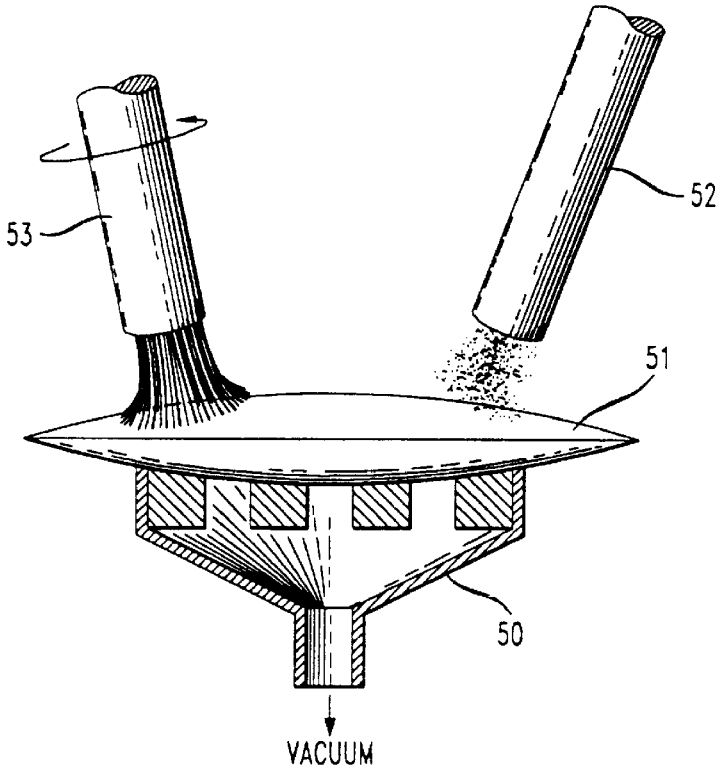
FIG. 5 shows a fourth embodiment of polishing apparatus.

FIG. 5 shows an alternative polishing apparatus particularly useful for polishing non-planar surfaces such as lenses. The apparatus comprises a sample holder 50 such as a vacuum holder for holding a lens 51, a tube 52 for delivering the polishing medium, and a polishing element 53 such as a rotating brush.

The invention can be more clearly understood by consideration of the following specific example.

EXAMPLE

A CVD diamond film deposited on a smooth Si substrate was cut into 1 cm×1 cm squares. The film had a surface roughness of ~90 Å. It was polished by using a slurry mixture consisting of about 25 volume percent of Mn powder (average particle diameter less than 45 μm) and about 75 volume percent of 10% hydrochloric acid in distilled water. A rotating brush (~300 rpm) was used to rub the polishing medium against the diamond surface for a duration of 30 minutes. The diamond sample was then washed with distilled water and etched with a 10% HCl solution followed by aqua regia ($HNO_3$:HCl=1:3). The root-mean-square surface roughness as measured by atomic force microscopy was reduced from ~90 Å to ~70 Å by the polishing.

Figure 6:
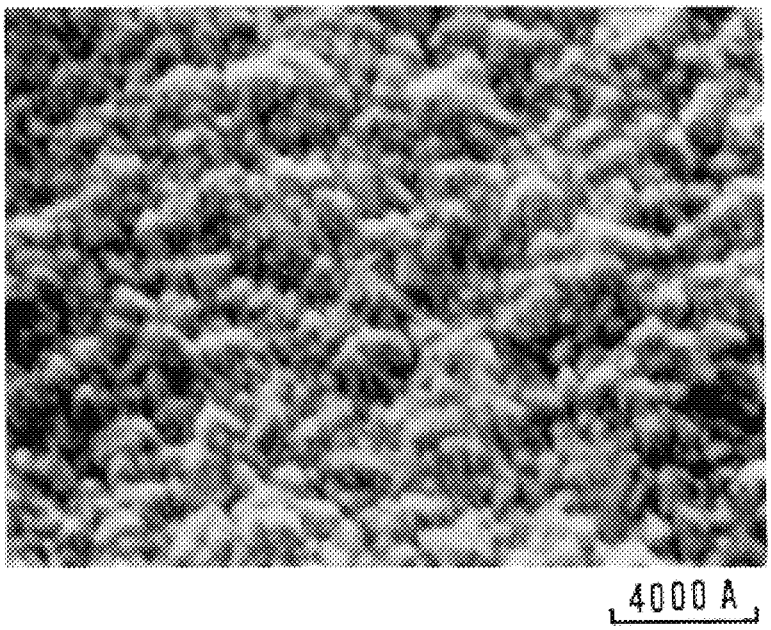
FIGS. 6 and 7 are scanning electron micrographs of diamond film surfaces before and after polishing.
Figure 7:
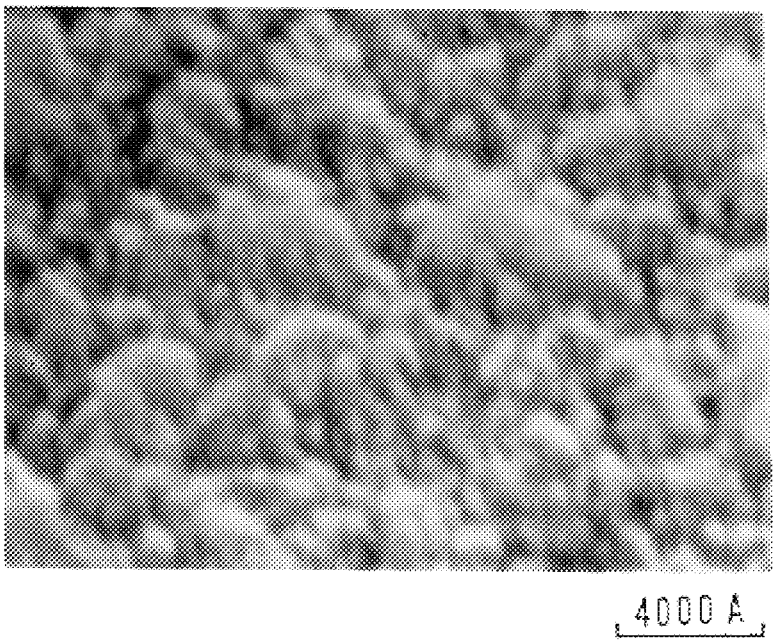

FIGS. 6 and 7 are SEM photomicrographs which illustrate the surface morphology of a sample before and after the polishing. The polished sample (FIG. 7) shows more smooth area as compared to the unpolished sample (FIG. 6). Atomic force microscopy on the smooth regions of the polished sample in FIG. 7 sample shows a surface roughness of about 30 Å.

It is to be understood that the above-described embodiments and examples are illustrative of only a few of the many possible specific embodiments which can represent applications of the principles of the invention. Numerous and varied other arrangements can be devised by those skilled in the art without departing from the spirit and scope of the invention.

The invention claimed is:

1. A method for fine polishing a diamond material comprising the steps of:

providing a surface of said material having a surface roughness of more than 50 Å;

applying to said surface a polishing medium comprising metal particles in a metal-dissolving carrier medium;

maintaining said polishing medium at a temperature of less than 200° C.; and rubbing said surface to produce a fine polished surface having a surface roughness reduced by at least 20 Å.

2. The method of claim 1 wherein said carrier medium is an aqueous acid solution.

3. The method of claim 2 wherein said metal particles comprise Mn, Fe or alloys thereof.

4. The method of claim 2 wherein said metal particles comprise Ce, La, Y or alloys thereof.

5. The method of claim 2 wherein said acidic carrier medium comprises hydrochloric acid, nitric acid, sulfuric acid, hydrofluoric acid, acetic acid or mixtures thereof.

6. The method of claim 1 wherein said metal particles have maximum particle size predominantly in the range 5–200 micrometers.

7. The method of claim 1 wherein said rubbing is by a brush rotating in the range of 100–1000 rpm.

* * * * *